United States Patent [19]

Tokuno

[11] 4,076,114

[45] Feb. 28, 1978

[54] BOARD GROUPING APPARATUS

[75] Inventor: Masateru Tokuno, Nishinomiya, Japan

[73] Assignee: Rengo Co., Ltd., Osaka, Japan

[21] Appl. No.: 720,234

[22] Filed: Sep. 3, 1976

[30] Foreign Application Priority Data

Apr. 19, 1976 Japan ..... 51-45135

[51] Int. Cl.[2] ..... B65G 47/29

[52] U.S. Cl. ..... 198/425; 93/93 DP; 198/491; 271/182

[58] Field of Search ..... 198/422, 423, 425, 491, 198/539, 600, 462; 271/182, 202, 229, 245; 93/93 R, 93 DP

[56] References Cited

U.S. PATENT DOCUMENTS

| | | | |
|---|---|---|---|
| 863,590 | 8/1907 | Cowley | 198/600 X |
| 1,030,479 | 6/1912 | Ofstad | 198/600 X |
| 1,680,842 | 8/1928 | Bausman | 198/425 |
| 2,769,520 | 11/1956 | Davidson et al. | 198/491 X |
| 3,149,834 | 9/1964 | Faeber | 198/425 X |
| 3,217,859 | 11/1965 | Bartlo et al. | 198/425 |
| 3,247,981 | 4/1966 | Johnson | 198/422 X |
| 3,834,288 | 9/1974 | Behrens et al. | 93/93 DP X |
| 3,908,836 | 9/1975 | Ikeda | 271/245 X |

*Primary Examiner*—Evon C. Blunk
*Assistant Examiner*—James L. Rowland
*Attorney, Agent, or Firm*—Birch, Stewart, Kolasch & Birch

[57] ABSTRACT

This invention relates to a board grouping apparatus wherein boards successively discharged from a rotary cutter which cuts a web, for example, a corrugated board web and which continuously, transversely feeds the boards of a suitable length onto a conveyor to group the boards on the conveyor in any suitable predetermined number of sheets.

3 Claims, 3 Drawing Figures

BOARD GROUPING APPARATUS

BACKGROUND OF THE INVENTION

This invention relates to a board grouping apparatus wherein boards successively discharged from a rotary cutter which cuts a web, e.g. corrugated board web, and which continuously, transversely feeds the boards of a suitable length onto a conveyor to group the boards on the conveyor in any suitable number of sheets.

To group the boards in any suitable number of sheets the boards successively discharged from a rotary cutter which cuts a web, e.g. corrugated board web, and which continuously transversely feeds the boards of a suitable length onto a conveyor, it is necessary in order to facilitate the transportation, arrangement, storage etc. of the boards to group the boards in batches. This present invention meets the above-mentioned needs.

SUMMARY OF THE INVENTION

It is an object of the present invention to provide a board grouping apparatus wherein boards successively discharged from a rotary cutter which cuts a web and continuously, transversely feeds said boards of a suitable length onto a conveyor to group the boards on the conveyor in any suitable number of sheets. The apparatus comprises a board transporting conveyor having a detour portion in which a portion of the transporting path of a belt passes through a pair of upper guide rolls and lower guide rolls to a position lower than the transportation plane. The apparatus further includes a stopper turnably supported at a position below said transportation plane of said conveyor in said detour portion, and means to turn said stopper so as to protrude the stopper above said transportation plane of said conveyor in order to raise a board on said conveyor by said stopper and to thus stop the movement of said board.

Another object of the present invention is to provide the aforementioned board grouping apparatus wherein said stopper comprises a lateral shaft arranged in said detour portion and rotatably supported on a frame of said conveyor, a first plate secured to said lateral shaft so as to protrude from the interior of said detour portion to a position above said transportation plane of said conveyor to assume a substantially horizontal posture in response to the turning of said lateral shaft. The stopper further includes a second plate joined to said first plate so as to protrude from the interior of said detour portion to a position above said transportation plane of said conveyor to assume an inclined posture opposite to the feed direction of said conveyor in response to the turning of said lateral shaft, and an antiskid seat secured to the upper surfaces of said first and second plates.

Still another object of the present invention is to provide the aforementioned board grouping apparatus characterized in that said means to turn said stopper is a piston and cylinder assembly.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the scope and spirit of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
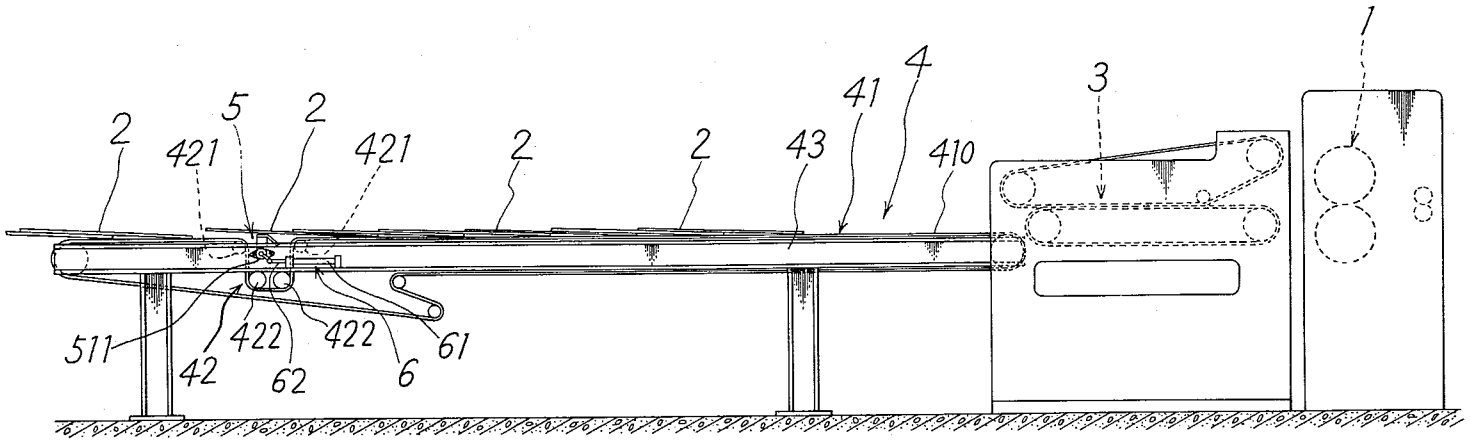
FIG. 1 is a side view of board grouping apparatus.
Figure 2:
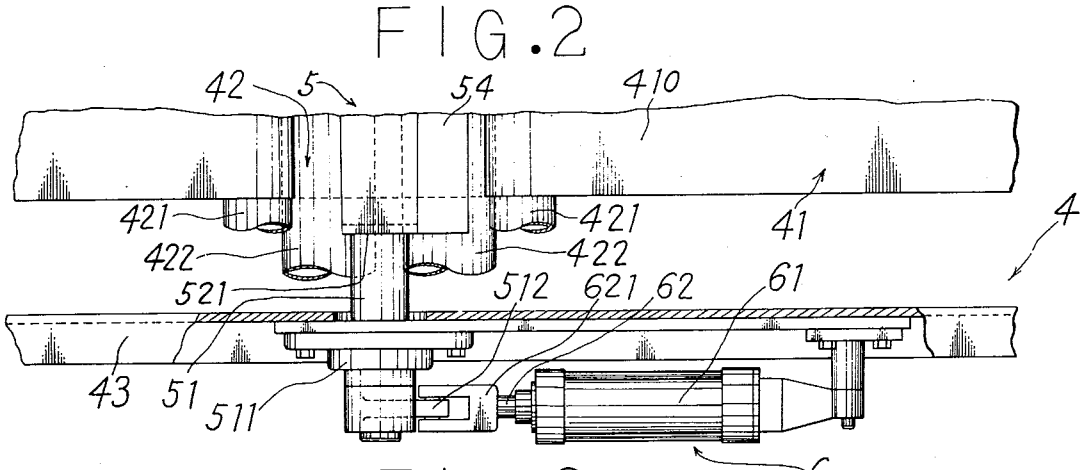
FIG. 2 is a plan view showing a part of a stopper of the board grouping apparatus.
Figure 3:
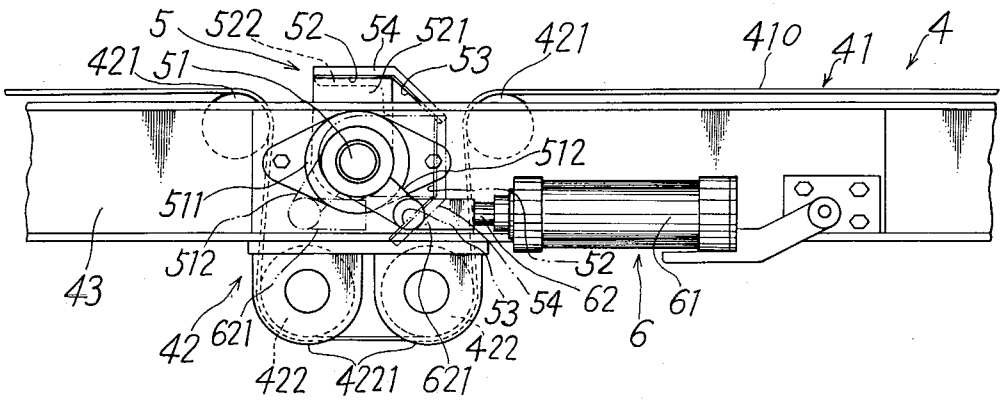
FIG. 3 is a side view showing the stopper of the board grouping apparatus.

An embodiment of the present invention will be described with reference to FIGS. 1 to 3. As apparent from FIG. 1, the board grouping apparatus is composed of a board transporting conveyor 4 which has a detour portion 42 wherein a part of the transporting path of a conveyor belt 41 which is close to a delivery end passes through a position lower than the transportation plane 410. The board grouping apparatus further includes a stopper 5 which is turnably supported at a position lower than the transportation plane 410 of the conveyor 4 in the detour portion 42, and an air cylinder 6 which turns the stopper 5 so as to protrude the stopper 5 above the transportation plane 410 of the conveyor 4 in order to raise a board 2 on the conveyor 4 and thus stop the movement of the board by means of the stopper 5. The detour portion 42 is composed of two parallel upper rolls 421 which are spaced apart and rotatably mounted on an upper end part of a frame 43 of the conveyor 4. In addition, the detour portion includes two parallel lower rolls 422 which are rotatably mounted on the bearing plates 4221 at a lower end portion of the conveyor frame 43 between the two rolls 421. Further, the detour portion includes a portion of the conveyor belt 41 which is guided by the upper rolls 421 and the lower rolls 422 so that the shape of the conveyor belt portion as viewed from the side may be substantially U-shape. As is apparent from FIGS. 2 and 3, the stopper 5 is composed of a lateral shaft 51 which is arranged in the detour portion 42 and which is rotatably supported through a bearing 511 by the conveyor frame 43. The stopper 5 further includes a first plate 52 which is secured to the lateral shaft, a second plate 53 which is joined to the first plate, and an antiskid seat 54 which is secured to the upper surfaces of the first plate 52 and the second plate 53. Two parallel side plates 521 (only one of which is shown in the drawings) are erected at right angles with the lateral shaft 51, and the respective end portions of these side plates 521 are coupled by an angle member 522. The first plate 52 is secured to the lateral shaft 51 by means of the side plates 521 as well as the angle member 522 so as to protrude from the interior of the detour portion 52 to a position above the transportation plane 410 of the conveyor 4 and to assume a horizontal posture when the lateral shaft 51 is turned by substantially 90° counterclockwise in FIGS. 1 and 3. Further, the second plate 53 is joined to the first plate 52 so as to be opposed to the feed direction of the conveyor 4, i.e., to assume a posture inclining by substantially 45° clockwise in FIGS. 1 and 3, when the first plate 52 protrudes above the transportation plane of the conveyor 4 and assumes the horizontal posture as shown in FIGS. 1 and 3, a free edge of the second plate 53 remains in the detour portion 42 when the first and second plates 52 and 53 are in position to stop the boards. The stopper is designed in this manner to prevent a biting motion of the plate 53 with the boards when the stopper 5 is lowered into the detour portion 42. A cylinder tube 61 of the air cylinder 6 is pivotally mounted on the conveyor frame 43. A fork member 621 is secured to the fore end of a piston rod 62, and is pivotally mounted on an end portion of the lateral shaft 51 through an arm 512. When the piston rod 62 protrudes from the cylinder tube 61, the stopper 5 sinks below the transportation plane 410 of the conveyor 4 as indicated by phantom lines in FIG. 3. When the piston rod 62 retreats into the cylinder tube 61, the stopper 5 turns by substantially 90° counterclockwise as shown in FIG. 3 and emerges above the transportation plane 410 of the conveyor 4.

The state of use of the board grouping apparatus described above will be explained hereinafter. A web, for example, a corrugated board web (not shown) is continuously fed and cut into suitable lengths by a rotary cutter 1, and thus formed into boards 2. The boards are received by a delivery conveyor 3 arranged between the rotary cutter 1 and the conveyor 4, and are thereafter discharged in succession onto the belt 41 of the conveyor 4. When the stopper 5 below the transportation plane 410 of the conveyor 4, the boards 2 will pass over the detour portion 42 continuously and in an overlapping state by means of the belt 41 and are thus transported towards the next stage of work. Subsequently, when the piston rod of the air cylinder 6 is withdrawn into the cylinder tube 61 so as to cause the stopper 5 to emerge above the transportation plane of the board transporting conveyor 4, the board 2 which is passing over the detour portion 42 is pushed upward by the stopper 5, and thus its movement is stopped together with the succeeding boards by a frictional force which acts between it and the antiskid seat 54 of the stopper 5. Therefore, the boards 2 which have already passed through the detour portion 42 are separated from the board 2 on the stopper 5 and are transported to the next stage of work by the conveyor belt 41. As a result, a gap arises in the flow of the boards. Further, when the stopper 5 is positioned below the transportation plane 410 of the board transporting conveyor 4 after a previously determined number of revolutions of the rotary cutter 1, the boards 2 which were stopped are again transported by the conveyor belt 41. The operations of the stopper 5 as described above are periodically repeated, whereby the continuous boards 2 are grouped in any suitable number of sheets.

Thus, according to the present invention, there can be provided a board grouping apparatus which is simple in structure, reliable in operation and capable of executing the grouping of boards with little board disorder.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A board grouping apparatus wherein boards successively discharged from a rotary cutter which cuts a web of material such as a corrugated web, and continuously, transversely feeds said boards of a suitable length onto a conveyor to group the boards in any suitable number of sheets, said apparatus comprising:

a board transporting belt conveyor;

a detour portion wherein the transporting surface of the belt of said conveyor passes through a substantially U-shaped path;

said substantially U-shaped path of said detour portion includes a first upper guide roll, a first lower guide roll, a second lower guide roll being parallel to the first lower guide roll and a second upper guide roll mounted above said second lower guide roll;

a stopper comprising first and second members;

said first member of said stopper being fixed to a rotatable transverse shaft arranged within said detour portion of said transporting belt conveyor; said first member of said stopper being movable to protrude above a transportation plane of said transporting belt conveyor from within said detour portion of said transporting belt conveyor by the rotation of said transverse shaft;

said first member of said stopper assumes a substantially horizontal posture in the fully protruded position;

said second member of said stopper being joined to said first member so as to be inclined relative to said first member of said stopper in a direction opposite to a feed direction of said transporting belt conveyor;

said second member of said stopper substantially protrudes above the transportation plane of said transporting belt conveyor when said first member of said stopper protrudes above the transportation plane;

said second member of said stopper includes a portion which is within said detour portion when said first member of said stopper protrudes above the transportation plane of said transporting belt conveyor; and means for rotating said transverse shaft.

2. A board grouping apparatus according to claim 1, wherein said first and second members of the stopper are provided with antiskid means.

3. A board group apparatus according to claim 1, wherein said means for rotating the transverse shaft comprises an arm fixed on said transverse shaft and a piston cylinder assembly to drive said arm.

* * * * *